US008021176B2

(12) United States Patent
Sekino et al.

(10) Patent No.: US 8,021,176 B2
(45) Date of Patent: Sep. 20, 2011

(54) POWER SUPPLY CONNECTOR

(75) Inventors: Masahiro Sekino, Tokyo (JP); Norio Shimizu, Nagano (JP); Nagaaki Muro, Kawasaki (JP); Yuusaku Hata, Tokyo (JP); Tsutomu Kanetsuna, Yokohama (JP); Kazuhide Ashida, Nagano (JP); Shun Egusa, Yokohama (JP); Kenji Sato, Tokyo (JP); Kenji Shigehisa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/680,579

(22) PCT Filed: Sep. 24, 2008

(86) PCT No.: PCT/JP2008/002626

§ 371 (c)(1),
(2), (4) Date: Jul. 6, 2010

(87) PCT Pub. No.: WO2009/041019

PCT Pub. Date: Apr. 2, 2009

(65) Prior Publication Data

US 2010/0285677 A1 Nov. 11, 2010

(30) Foreign Application Priority Data

Sep. 28, 2007 (JP) ..... 2007-255626
Sep. 28, 2007 (JP) ..... 2007-255774

(51) Int. Cl.
*H01R 4/60* (2006.01)

(52) U.S. Cl. ..... 439/222; 439/924.1

(58) Field of Classification Search ..... 439/540.1, 439/924.1, 79, 218, 222
See application file for complete search history.

(56) References Cited

U.S. PATENT DOCUMENTS 3,581,480 A * 6/1971 O'Connor et al. ..... 56/11.9
4,245,875 A * 1/1981 Shaffer et al. ..... 439/144
5,545,046 A 8/1996 Masuda et al.
5,782,646 A * 7/1998 Broadfield et al. ..... 439/346
5,812,660 A * 9/1998 Suzuki et al. ..... 379/438
5,885,055 A * 3/1999 Wojtalewicz et al. ..... 414/790.4
6,053,763 A * 4/2000 Brennan et al. ..... 439/491
6,075,341 A * 6/2000 White et al. ..... 320/114

(Continued)

FOREIGN PATENT DOCUMENTS

JP 7192826 7/1995

(Continued)

*Primary Examiner* — Neil Abrams
*Assistant Examiner* — Phuong Nguyen
(74) *Attorney, Agent, or Firm* — Oblon, Spivak, McClelland, Maier & Neustadt, L.L.P.

(57) ABSTRACT

A power supply connector is provided, which is applicable to both large current charging and low current charging, the power supply connector being able to not only maintain the accuracy of monitoring low current charging and the volumetric efficiency of a board by appropriately arranging two types of connector parts, but also contribute to the downsizing of the power supply connector and improvement of the reliability thereof by striking a balance between the volumetric efficiency and the heat radiation characteristics, and ensure safety in the use of the power supply connector while reducing the cost. Insertion holes 4 and connector pins 2 that configure a large current charging connector part are disposed in the vicinity of both ends of the power supply connector 1. There are disposed a plug insertion hole 9 and low current charging connector pins 11 that configure a low current charging connector part held between the insertion holes 4 and the connector pins 2.

6 Claims, 5 Drawing Sheets

U.S. PATENT DOCUMENTS

| | | | | |
|---|---|---|---|---|
| 6,625,016 | B2 * | 6/2000 | White et al. | 320/114 |
| 7,540,748 | B2 * | 6/2009 | Tracy et al. | 439/131 |
| 7,874,857 | B2 * | 1/2011 | Takei et al. | 439/218 |
| 2010/0062650 | A1 * | 3/2010 | Nakamura | 439/638 |
| 2011/0051371 | A1 * | 3/2011 | Azuma et al. | 361/699 |

FOREIGN PATENT DOCUMENTS

| | | |
|---|---|---|
| JP | 2004 362949 | 12/2004 |
| JP | 2006 313690 | 11/2006 |

* cited by examiner

POWER SUPPLY CONNECTOR

TECHNICAL FIELD

The present invention relates to a power supply connector that is disposed in a battery pack capable of being subjected to replenishment charging, and particularly to a power supply connector applicable to both large current charging and low current charging.

BACKGROUND ART

In recent years, a variety of moving vehicles have been developed, including hybrid motor vehicles, electrically-assisted bicycles, and industrial conveying vehicles used for conveyance within a factory. Such moving vehicles have a motor as a power source, therefore a battery pack for supplying electricity to the motor is a significant component. Such being the case, the battery pack has been improved in various ways. For example, in the technology described in Patent Document 1, a temperature sensor and heater are attached to a battery pack, and decline in function of the battery pack caused by low temperature is prevented by increasing the temperature using the heater.

In a general structure of a battery pack, a plurality of battery cells are connected in series to construct an assembled battery, and the assembled battery is disposed in a pack case. As the battery cells, it is appropriate to use a lithium-ion battery that can be subjected to replenishment charging when the battery wears out. Such a battery pack is installed with a power supply connector that has an insertion part to which a charging plug is inserted, and this power supply connector charges the battery from an external power supply.

In a normal power supply connector, the insertion part is provided in a connector front surface part that is exposed to a pack case outer surface part of a battery pack, and the charging plug connected to the external power supply is inserted into this insertion part. Moreover, two connector pins that extend backward from the insertion part are disposed on the rear surface part side of the power supply connector.

A circuit board provided with a protection circuit or a metal plate such as a bus bar is connected to the connector pins and charging is performed by feeding a current from the external power supply to the assembled battery within the pack case.

It is required for such a battery pack to carry out large current charging (at least 30 A) suitable outside of home or within a factory, not to mention low current charging (less than 30 A) using a household power supply. For this reason, in the power supply connector installed in the battery pack, two types of charging plugs, a large current charging plug and a low current charging plug, are inserted desirably so that large current charging and low current charging can be executed.

On the other hand, in order to obtain a power supply connector applicable to both large current charging and low current charging, there has been developed a power supply connector provided with two types of insertion parts on the front surface part side, to which the two types of plugs are inserted, and two types of connector pins on the rear surface part side, which extend backward from the insertion parts. Here, the large current charging plug is relatively larger than the low current charging plug. Thus, in order to conform with the size of the plugs, a large current charging insertion part or connector pin of the power supply connector are larger than a low current charging insertion part or connector pin.

Therefore, the conventional power supply connector applicable to large current charging has the following problems due to the large-diameter large current charging connector pin. The configuration of the conventional power supply connector is now illustrated in detail with reference to the side view of FIG. 7, and the problems of the large-diameter large current charging connector pin are described.

As shown in FIG. 7, the power supply connector 1 is disposed in a pack case of a battery pack capable of being subjected to replenishment charging, wherein the large-diameter large current charging connector pin 2 is disposed on the rear surface side (on the right rim part side in FIG. 7). The large current charging connector pin 2 extends backward from a rear surface part of the power supply connector 1 (to the right in FIG. 7), and a circuit board or metal plate 3 that is embedded in the battery pack is installed below the large current charging connector pin 2.

The large current charging connector pin 2 is connected to the circuit board or the metal plate 3. Because the large current charging connector pin 2 has a large diameter and thus requires a space in a height direction, which reduces the volumetric efficiency of the power supply connector 1. Moreover, because of the large diameter of the large current charging connector pin 2, the cross-sectional area of the connecting wiring that connects the large current charging connector pin 2 with the circuit board or the metal plate 3 increases. Therefore, the amount of heat generated in the section of this connecting wiring is large.

In addition, the large cross-sectional area of the connecting wiring connecting the large current charging connector pin 2 with the circuit board or the metal plate 3 makes the connecting work itself difficult and consequently reduces the workability. Especially a battery pack of an electric bicycle needs to be made strong against shock such as vibration and sideway push, thus it is essential to ensure excellent connection strength and a reliable connecting work. Therefore, it is urgent to improve the work efficiency in the work of connecting the large current charging connector pin 2 with the circuit board or the metal plate 3.

On the other hand, as one of the methods for obtaining the power supply connector applicable to both large current charging and low current charging, there is considered a method for using the same connector pin in both large current charging and low current charging to enhance space utilization and improve the volumetric efficiency of the power supply connector. However, when using the same connector pin in both large current charging and low current charging, the size of the connector pin always needs to match the size corresponding to large current charging.

For this reason, in the circuit board connected to the connector pin, it is inevitable to adopt a circuit suitable for monitoring large current charging, as a protection circuit used for monitoring charging. As a result, not only the accuracy of monitoring low current charging but also the volumetric efficiency of the circuit board is reduced, causing a cost increase.

In order to maintain the accuracy of monitoring low current charging and the volumetric efficiency of the circuit board, there is considered a method for providing separately a large current charging connector pin with a large diameter and a low current charging connector pin with a small diameter, and providing separately a special protection circuit suitable for monitoring low current charging and a special protection circuit suitable for monitoring large current charging. In this case, the large current charging connector pin has a large diameter and the low current charging connector pin has a small diameter. Regarding the insertion parts for inserting charging plugs thereto, because a low current charging insertion part is smaller than a large current charging insertion part, a large current charging connector part having the insertion part and the connector pin is larger than a low current charging connector having the same.

Here, FIGS. 8 and 9 are used for described an example of a conventional connector that has two types of connector parts, a large current charging connector and a low current charging connector. In a power supply connector 1 shown in FIG. 8, two large current charging current pin insertion parts 14 included in a large current charging connector part, and two low current charging current pin insertion parts 15 included in a low current charging connector part are arranged in a line from the left to the right of the diagram. In a power supply connector 1 shown in FIG. 9, two large current charging current pin insertion part 14 are arranged on the lower side, and two low current charging current pin insertion parts 15 are arranged thereabove, forming a two-stage configuration.

{Patent Document 1}: 2004-362949

However, the conventional power supply connectors 1 shown in FIGS. 8 and 9 have the following problems. In other words, while the accuracy of monitoring low current charging and the volumetric efficiency of the board are improved, the volumetric efficiency of the power supply connectors 1 themselves drop, enlarging the power supply connectors 1.

Specifically, in the example shown in FIG. 8, the width size is increased because the large current charging current pin insertion parts 14 functioning as the large current charging connector part and the low current charging current pin insertion parts 15 functioning as the low current charging connector part are arranged horizontally in a line. Furthermore, in the example shown in FIG. 9, the height size is increased because the large current charging current pin insertion parts 14 and the low current charging current pin insertion parts 15 are arranged vertically to form two stages.

In addition, because the amount of heat generated by the large current charging current pin insertion parts 14 is greater than that of the low current charging current pin insertion parts 15, good heat radiation characteristics have to be ensured. For this reason, the large current charging current pin insertion parts 14 are arranged with a predetermined distance or more therebetween and therefore cannot be downsized.

As described above, because the power supply connector applicable to both low current charging and large current charging increases in size, downsizing thereof is strongly desired. Especially for the current charging connector parts generating a large amount of heat, the performance thereof decreases if the heat radiation characteristics are low, which impinges the volumetric efficiency in terms of ensuring reliability. Hence, downsizing of the power supply connector has been a big issue.

Note that demand for the power supply connector applicable to both low current charging and large current charging has been increasing, and consequently technical demand has been rigorous yearly. For this reason, now only simply downsizing the power supply connector, but also ensuring safety in the use thereof and further reduction of the cost are required.

DISCLOSURE OF THE INVENTION

The present invention was proposed in order to solve the above-described problems of the conventional technology, and a first object of the present invention is to provide a power supply connector applicable to both large current charging and low current charging, the power supply connector being able to not only maintain the accuracy of monitoring low current charging and the volumetric efficiency of a board by appropriately arranging two types of connector parts, a large current charging connector part and a low current charging connector part, but also contribute to the downsizing of the power supply connector and improvement of the reliability thereof by striking a balance between the volumetric efficiency and the heat radiation characteristics, and ensure safety in the use of the power supply connector while reducing the cost.

Furthermore, a second object of the present invention is to provide a power supply connector applicable to at least large current charging, the power supply connector being able to enhance the volumetric efficiency, connection strength, and connecting work efficiency by increasing the area of contact between a connector pin and a circuit board or metal plate, and to improve the reliability and performance of the power supply connector by reducing heat generated by the connection part between the connector pin and the circuit board or the metal plate.

In order to achieve the objects described above, the present invention is a power supply connector in which a front surface part is provided with a plurality of insertion parts including a pair of large current charging insertion parts into which large current charging plugs are inserted, a rear surface part is provided with a plurality of connector pins including a pair of large current charging connector pins, and these connector pins are connected with a circuit board or a metal plate to form a large current charging connector part configured by the pair of large current charging insertion parts and the pair of large current charging connector pins, wherein the connector part or the configuration of the connector pins configuring the connector part is improved.

First of all, a power supply connector according to a first aspect for achieving the first object of the present invention has the following characteristics in an arrangement configuration of the connector part configured by the insertion parts and the connector pins. In other words, in the power supply connector for achieving the first object, the large current charging connector part is configured by two positionally divided sections. These divided sections are disposed and separated by a space such that one end of each of the divided sections is positioned in the vicinity of both ends of the front surface part, and a low current charging connector part is disposed in a position between these two divided sections.

As a result of using the power supply connector of the first aspect having the configuration mentioned above, the large current charging connector part is positionally divided into two sections, which are separated by a space at both ends of the power supply connector, and the low current charging connector part is disposed therebetween. As a result, a large space can be secured for the large current charging connector part, and excellent heat radiation characteristics can be ensured. At the same time, the space can be effectively used by disposing the low current charging connector part between the large current charging connector parts, and the volumetric efficiency of the power supply connector can be increased.

Moreover, in the present invention, a power supply connector according to a second aspect for achieving the second object is characterized in that the plurality of connector pins are each provided with a flat surface part that is in surface contact with the circuit board or the metal plate.

As a result of using the power supply connector of the second aspect having the configuration mentioned above, the flat surface parts are provided to the connector pins, and the flat surface parts are brought into surface contact with the circuit board or the metal plate to connect them, so that a large contact area can be obtained. Therefore, the large-diameter connector pins can be simply and stably attached to the circuit board or the metal plate. By increasing the contact area between the connector pins and the circuit board or the metal plate, the connection sections therebetween can exhibit excellent heat radiation characteristics, thus this power supply connector is suitable as the power supply connector applicable to large current charging.

As a result of using the power supply connector of the first aspect of the present invention, striking a balance between the volumetric efficiency and the heat radiation characteristics can be achieved by the extremely simple configuration where the low current charging connector part is disposed between the large current charging connector parts, thus downsizing of the power supply connector and improvement of the reliability thereof can be achieved.

As a result of using the power supply connector of the second aspect of the present invention, a large contact area can be obtained by the extremely simple configuration where the flat surface parts are provided to the connector pins and the flat surface parts are brought into surface contact with the circuit board or the metal plate. As a result, the volumetric efficiency, connection strength and connecting work efficiency can be improved significantly, and the amount of heat generated in the connection sections between the connector pins and the circuit board or the metal plate can be reduced significantly, whereby the reliability and performance of the power supply connector can be enhanced.

EXPLANATION OF REFERENCE NUMERALS

Figure 1:
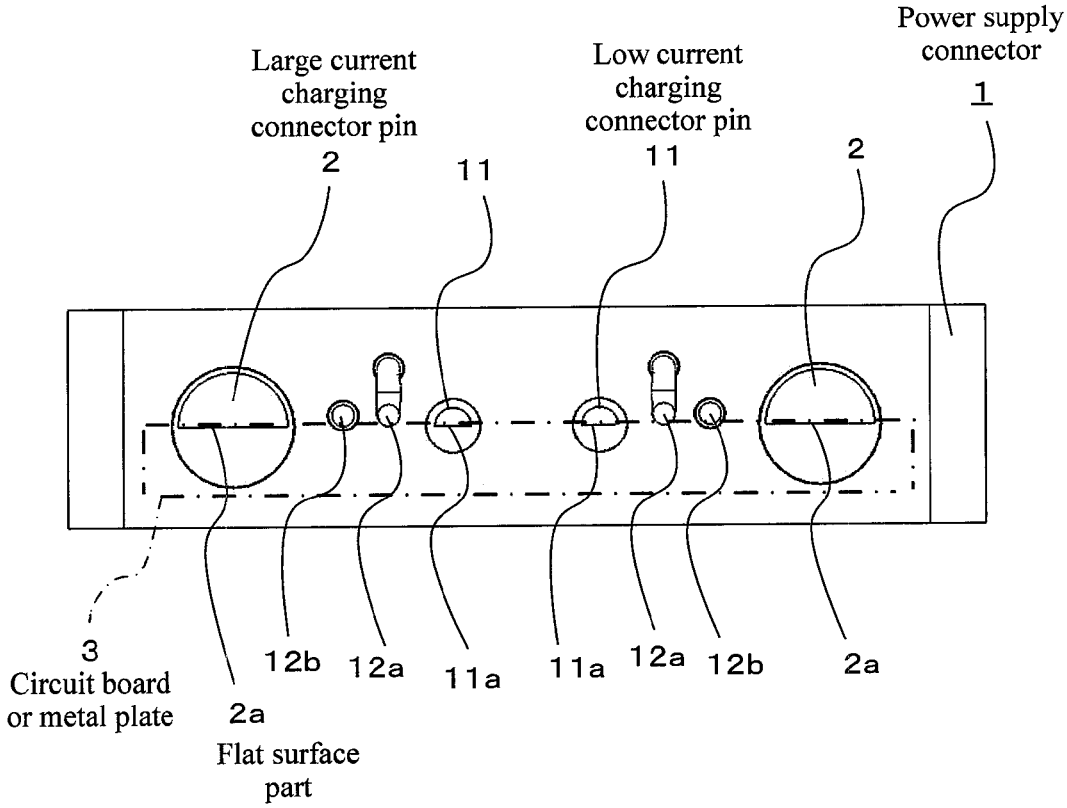
FIG. 1 is a back view of a representative embodiment of the present invention.

1 . . . Power supply connector
1*a* . . . Fitting part
2 . . . Large current charging connector pin
2*a*, 11*a* . . . Flat surface part
3 . . . Circuit board or metal plate
4 . . . Pin insertion hole
5 . . . Large current charging plug
6 . . . Current pin
7*a*, 7*b* . . . Signal pin insertion hole
8*a*, 8*b*, 12*a*, 12*c* . . . Signal pin
9 . . . Plug insertion hole
10 . . . Low current charging plug
11 . . . Low current charging connector pin
13 . . . Screw
14 . . . Large current charging current pin insertion part
15 . . . Low current charging current pin insertion part

BEST MODE FOR CARRYING OUT THE INVENTION

(1) Representative Embodiment

Figure 2:
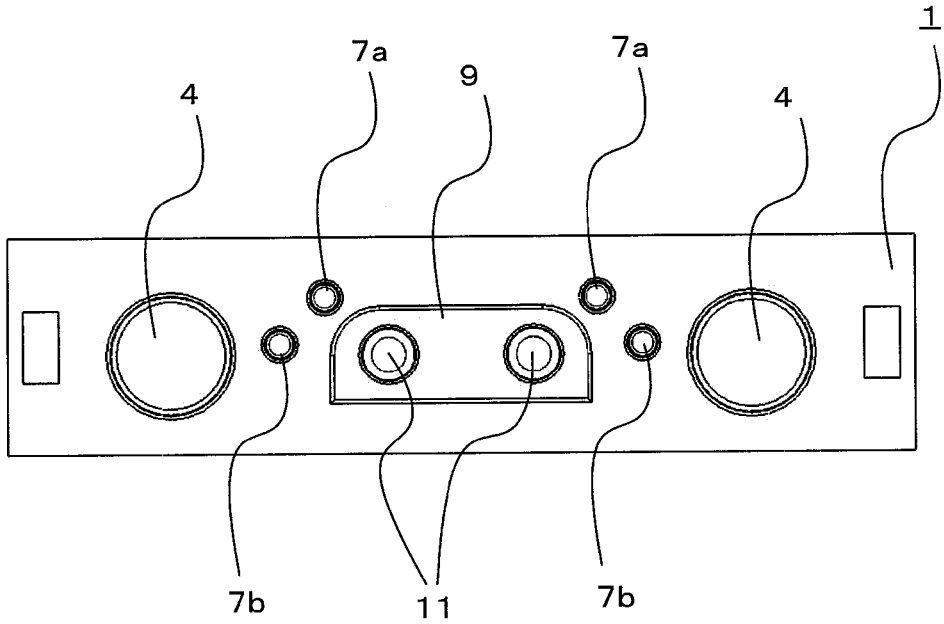
FIG. 2 is a font view of a present embodiment.
Figure 3:
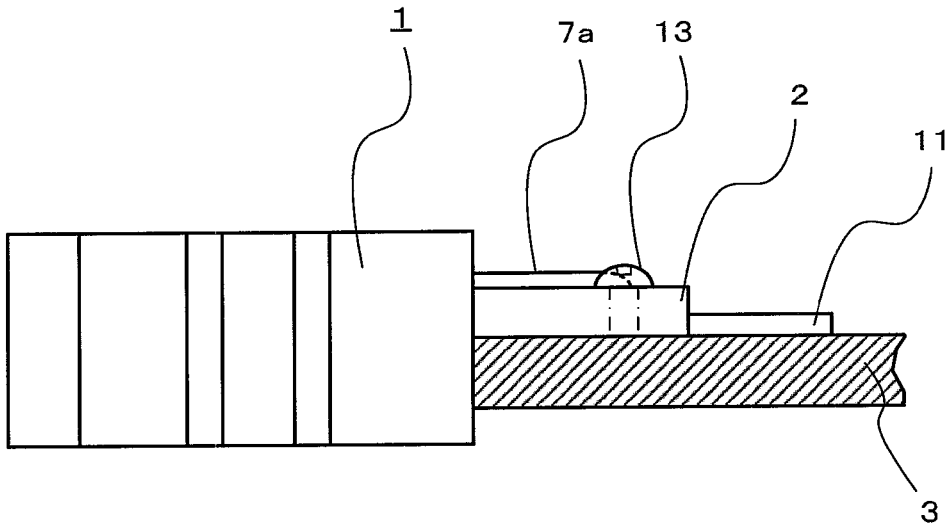
FIG. 3 is a side view of the present embodiment.
Figure 4:
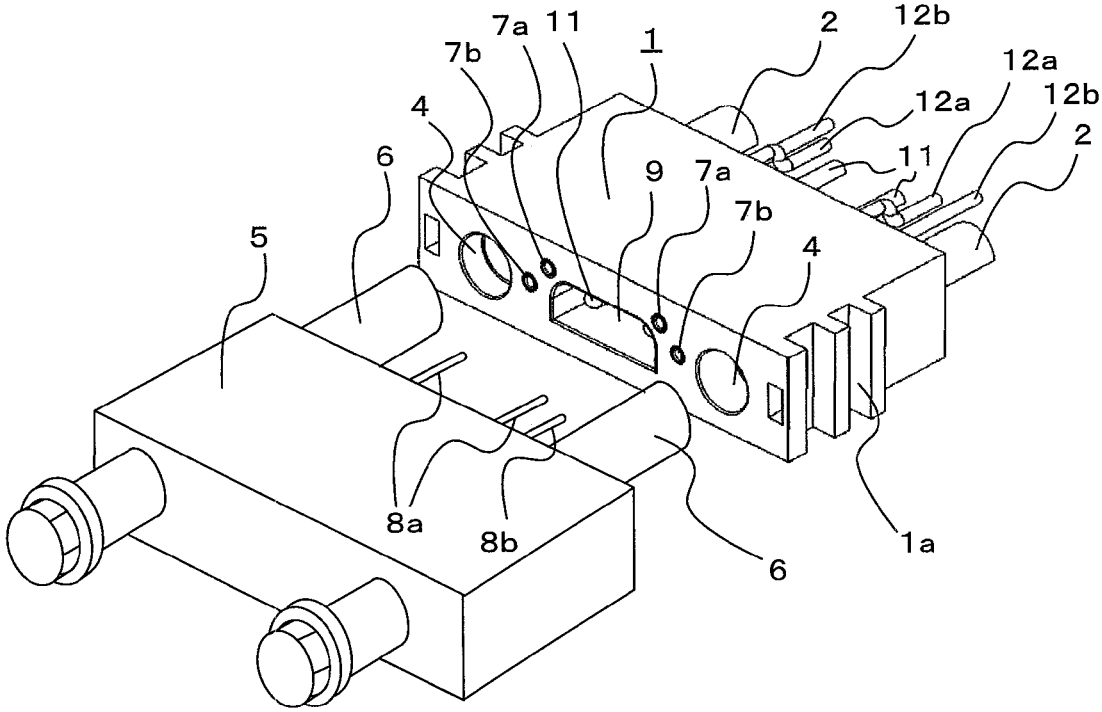
FIG. 4 is a perspective view showing how large current charging is executed in the present embodiment.

A representative embodiment according to the power supply connector of the present invention is now described hereinafter in detail with reference to FIGS. 1 to 5. FIG. 1 is a back of the present embodiment, FIG. 2 a front view of the present embodiment, FIG. 3 a side view of the present embodiment, and FIGS. 4 and 5 perspective view of the present embodiment. FIG. 4 shows how large current charging is executed, and FIG. 5 show how low current charging is executed.

[Configuration Outline]

As shown in FIGS. 1 to 5, a power supply connector 1 is disposed in a pack case of a battery pack that can be subjected to replenishment charging. The power supply connector 1 is a type that is applicable to two types of power sources: a household or factory large current power source carrying out large current charging by means of the power supply connector 1, and a household power source carrying out low current charging by means of the power supply connector 1.

Figure 5:
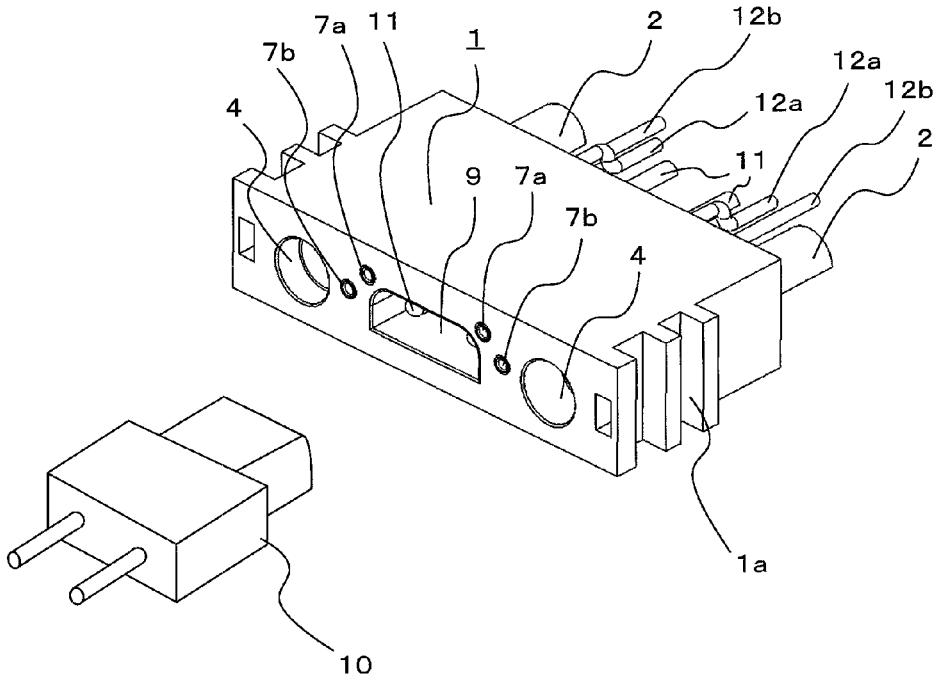
FIG. 5 is a perspective view showing how low current charging is executed in the present embodiment.

One of the characteristics of the present embodiment is that, as shown in FIGS. 4 and 5, a large current charging connector part configured by a pair of insertion holes 4 and a pair of large current charging connector pins 2 are disposed and separated by a space as two divided sections that are positioned in the vicinity of left and right ends as viewed from the front of the power supply connector 1, and that there are disposed a plug insertion hole 9 and low current charging connector pin 11 that configure a low current charging connector part held between these two divided sections.

Here, the left and right individual divided sections of the large current charging connector part are configured by the pin insertion holes 4 functioning as the insertion parts on the front surface part side, two signal pin insertion holes 7*a*, 7*b*, the large current charging connector pins 2 functioning as the connector pins on the rear surface part side, and two signal pins 12*a*, 12*b*, as shown in FIGS. 4 and 5. Moreover, the low current charging connector part is configured by the plug insertion hole 9 functioning as the insertion part on the front surface part side, and a pair of low current charging connector pins 11 extending from the inside of the plug insertion hole 9 to the rear surface part.

One of the characteristics of the present embodiment is that, as shown in FIG. 1, each of the large current charging connector pins 2 and each of the low current charging connector pins 11 are provided with flat surface parts 2*a*, 11*a*, respectively, and that these flat surface parts 2*a*, 11*a* are brought into surface contact with a circuit board or a metal plate 3.

It should be noted that left and right edges of the power supply connector 1 are provided with a fitting part 1*a* that projects horizontally so as to be fitted to a pack case inner wall of a battery pack, whereby the fitting part 1*a* is attached to the inside of the battery pack.

[Configuration of Front Surface]

First of all, the configuration of the front surface of the power supply connector 1 is described. As shown in FIGS. 2 and 4, the large-diameter pin insertion holes 4 are formed one by one in left and right ends of a front surface part of the power supply connector 1 to configure the pair of left and right pin insertion holes 4. A pair of current pins 6 of a large current charging plug 5 connected to a factory large current power source is inserted into the pair of pin insertion holes 4 (see FIG. 4). Furthermore, on the inner side from the pair of pin insertion holes 4, two pairs of (total of four) signal pin insertion holes 7*a*, 7*b* are disposed in two vertical stages on the left and right sides so as to form a truncated chevron shape when viewed from the front.

In other words, the space between the two upper signal pin insertion holes 7*a* is narrow, but the space between the two lower signal pin insertion holes 7*b* is wide. In this manner, the four signal pin insertion holes 7*a*, 7*b* are disposed asymmetrically with respect to a vertical direction as a whole. Two pairs of truncated chevron-shaped signal pins 8*a*, 8*b* that are provided in the large current charging plug 5 are inserted into these two pairs of truncated chevron-shaped signal pin insertion holes 7*a*, 7*b* (see FIG. 4).

In addition, as shown in FIGS. 2 and 5, in the front surface part of the power supply connector 1, the plug insertion hole 9 is formed on the inner side from the vertical two pairs of signal pin insertion holes 7*a*, 7*b*. The cross section of the plug insertion hole 9 forms a horizontally long saddle shape, wherein left and right ends on the upper side part are curved and left and right ends on the lower side part are bent at a right angle, thus the upper side part and the lower side part are vertically asymmetric.

The pair of left and right small-diameter low current charging connector pins 11 is disposed inside the plug insertion hole 9. The pair of low current charging connector pins 11 is disposed so as to extend backward from the plug insertion hole 9, and penetrates the power supply connector 1 to project toward the rear surface. A low current charging plug 10 that is connected to the household power source is inserted into the plug insertion hole 9 (see FIG. 5). The cross section of the low current charging plug 10 forms a horizontally-long saddle shape so as to be conformed with the shape of the plug insertion hole 9.

When the low current charging plug 10 is inserted into the plug insertion hole 9, the low current charging connector pins 11 inside the plug insertion hole 9 are inserted into pin insertion holes (not shown) of the low current charging plug 10. Consequently, the low current charging connector pins are electrically connected with the low current charging plug 10 inserted into the plug insertion hole 9.

[Configuration of Rear Surface]

The rear surface of the power supply connector 1 is described next. As shown in FIG. 1 and FIGS. 3 to 5, the large-diameter large current charging connector pins 2 are disposed one by one at left and right ends of a rear surface part of the power supply connector 1 to configure the pair of left and right large current charging connector pins 2. Each of the large current charging connector pins 2 is disposed so as to extend backward from each of the pin insertion holes 4 of the front surface part, and is electrically connected with each of the current pins 6 of the large current charging plug 5. Moreover, in the vicinity of the center of the rear surface part of the power supply connector 1, the pair of low current charging connector pins 11 extending backward from the inside of the plug insertion hole 9 of the front surface part penetrate the power supply connector 1 to project toward the rear surface.

Tip ends of the connector pins 2, 11 projecting toward the rear surface are provided with, respectively, flat surface parts 2*a*, 11*a* that have a semicircular cross section to face downward. The circuit board or the metal plate 3 (shown by the chain line in FIG. 1) is provided in proximity to these flat surface parts 2*a*, 11*a*. The flat surface parts 2*a*, 11*a* of the connector pins 2, 11 are all in surface contact with the circuit board or the metal plate 3 and positioned on the same plane surface. Furthermore, as shown in FIG. 3, the connector pins 2 are screwed on the circuit board or the metal plate 3 by screws 13.

In the power supply connector 1 of the present embodiment, the circuit board that is electrically connected with the connector pins is provided with two types of protection circuits separately: a large current charge monitoring protection circuit and a low current charge monitoring protection circuit. In other words, when the circuit board or metal plate 3 shown in FIG. 1 is the circuit board, this circuit board is provided with the two types of protection circuits. When the circuit board or metal plate 3 shown in FIG. 1 is a bus bar or other metal plate connected to a circuit board, this connection destination circuit board is provided with the two types of protection circuits.

In the rear surface part of the power supply connector 1, two pairs of signal pins 12*a*, 12*b* are disposed internally and externally between the pair of large current charging connector pins 2 formed at the left and right ends and the pair of low current charging connector pins 11 formed at the center. In other words, a pair of signal pins 12*a* is provided immediately outside the pair of low current charging connector pins 11, and the other pair of signal pins 12*b* is disposed on the outside of the pair of signal pins 12*a*. These four signal pins 12*a*, 12*b* are disposed such that base ends thereof project from the rear surface of the power supply connector 1, and the positions of the projection form a truncated chevron shape as viewed from the rear surface.

Specifically, as shown in FIG. 4, the inner pair of signal pins 12*a* is connected with the upper pair of signal pin insertion holes 7*a* of the front surface part and the upper pair of signal pins 8*a* of the large current charging plug 5, while the outer pair of signal pins 12*b* is connected with the lower pair of signal pin insertion holes 7*b* of the front surface part and the lower pair of signal pins 8*b* of the large current charging plug 5. However, in order to adjust top ends of the inner pair of signal pins 12*a* downward by the difference in height between the base ends of the outer pair of signal pins 12*a*, 12*b*, the inner pair of signal pins 12*a* is bent into a crank shape in accordance with the difference in height. With this crank, the two pairs of inner and outer signal pins 12*a*, 12*b* are disposed such that the height of each of the tip ends of the signal pins 12*a*, 12*b* is positioned on the same horizontal surface without being shifted vertically. More specifically, the tip ends of the two pairs of inner and outer signal pins 12*a*, 12*b* are disposed so as to be the same height as the horizontal surface where the flat surface parts 2*a*, 11*a* of the connector pins 2, 11 are located.

[Function Effects]

The present embodiment with the configurations described above has the following function effects. In other words, one of the characteristics of the present embodiment is that, as described above, the large current charging connector part configured by the pair of pin insertion holes 4 and the pair of large current charging connector pins 2 is disposed in the form of the two divided sections that are located separately at the left and right ends, and that the plug insertion hole 9 and the low current charging connector pins 11 that configure the low current charging connector part are disposed between these two division sections.

As a result of using the characteristics of the arrangement configuration of such connector parts, the space between the pair of pin insertion holes 4 and the pair of large current charging connector pins 2 of the large current charging connector part can be made wide so that excellent heat radiation characteristics can be obtained. Moreover, because the low current charging connector part is disposed between the two divided sections of the large current charging connector part that are disposed separately on both the left and right sides, the space of the power supply connector 1 can be utilized effectively, the heat radiation characteristics can be ensured, and at the same time the volumetric efficiency of the power supply connector 1 can be increased.

In addition, one of the characteristics of the present embodiment is that as described above, the large current charging connector pins 2 and the low current charging connector pins 11 are provided with the flat surface parts 2*a*, 11*a*, and that these flat surface parts 2*a*, 11*a* are brought into surface contact with the circuit board or the metal plate 3. By providing the horizontally disposed connector pins 2, with such flat surface parts, the height of the connector pins can be reduced more, compared to the case where the cross sections of the flat surface parts are in the shape of a simple circle. Particularly because the height of the large-diameter large current charging connector pins 2 has a large impact on the height of the power supply connector, the height of the power supply connector can be reduced by reducing the height of the large current charging connector pins 2.

In the present embodiment, the flat surface parts 2*a* are provided by forming the cross sections of the large current charging connector pins 2 into a semicircle. Therefore, with the same diameter, the height of the large current charging connector pins 2 having the semicircular cross sections becomes half of the height of the large current charging connector pins having circular cross sections, increasing the effects of reducing the height. By bringing the circuit board 3 into contact with the flat surface parts 2*a* of the large current charging connector pins 2 having the semicircular cross sections, the height of the circuit board 3 can be absorbed by the height of the large-diameter connector pins 2, as shown in FIG. 1. Thus, the volumetric efficiency of the power supply connector 1 can be improved, and the height of the power supply connector 1 can be reduced significantly.

Furthermore, because the connector pins 2, 11 are in surface contact with the circuit board 3 via the flat surface parts 2*a*, 11*a*, a large contact area can be obtained easily. This way, simplification and stabilization of the connecting work can be advanced easily, which allows a significant reduction of the production cost.

Moreover, by increasing the connection sections between the connector pins 2, 11 and the circuit board 3, the heat radiation characteristics of these sections can be improved significantly. In the present embodiment, because the large-diameter connector pins 2 are disposed at the both left and right ends of the power supply connector 1, the distance therebetween can be increased and the heat radiation characteristics can be further improved.

In the present embodiment, because the screws 13 are used for connecting the connector pins 2 to the circuit board 3, extremely excellent connection strength can be ensured. Therefore, the power supply connector 1 is suitably for the battery pack of the electric bicycle that is required to be strong against shock such as vibration and sideway push.

In the power supply connector 1 of the present embodiment, the signal pin insertion holes 7*a*, 7*b* and the plug insertion hole 9 are configured asymmetrically with respect to the vertical direction, so that there is no worry that the large current charging plug 5 and the low current charging plug 10 are vertically inserted in the wrong way. In this manner, safety in the use of the power supply connector can be enhanced. In the present embodiment, because the low current charge monitoring protection circuit and the large current charge monitoring protection circuit are provided separately on the circuit board, excellent monitoring accuracy can be achieved at the time of large current charging and low current charging, and the volumetric efficiency of the circuit board also improves.

As described above, the power supply connector 1 of the present embodiment has an extremely simple configuration in which the plug insertion hole 9 and the connector pins 11 that configure the low current charging connector part are disposed between the pin insertion holes 4 and the connector pins 2 that configure the large current charging connector part. Therefore, striking a balance between the volumetric efficiency and the heat radiation characteristics can be achieved, and downsizing and improvement of the reliability can be accomplished.

Because the power supply connector 1 of the present embodiment has an extremely simple configuration in which the large-diameter connector pins 2 are provided with the flat surface parts 2*a* respectively, the contact area between the connector pins and the circuit board or the metal plate 3 can be increased, improving the volumetric efficiency, connection strength, and connecting work efficiency. At the same time, reduction of the amount of heat generated in the connection section between each of the connector pins 2, 11 and the circuit board or the metal plate 3 can be realized, enhancing the reliability and performance. In addition, increasing the connecting work efficiency can contribute to a significant reduction of the production cost.

In addition, the large current charging plug 5 and the low current charging plug 10 can be securely prevented from being inserted in the wrong way, whereby safety in the use of the power supply connector can be ensured. Moreover, because the low current charge monitoring protection circuit and the large current protection circuit are provided independently on the circuit board 3, there is no risk of lowering the monitoring accuracy at the time of low current charging, and the volumetric efficiency of the circuit board can be kept high.

(2) Other Embodiment

Figure 6:
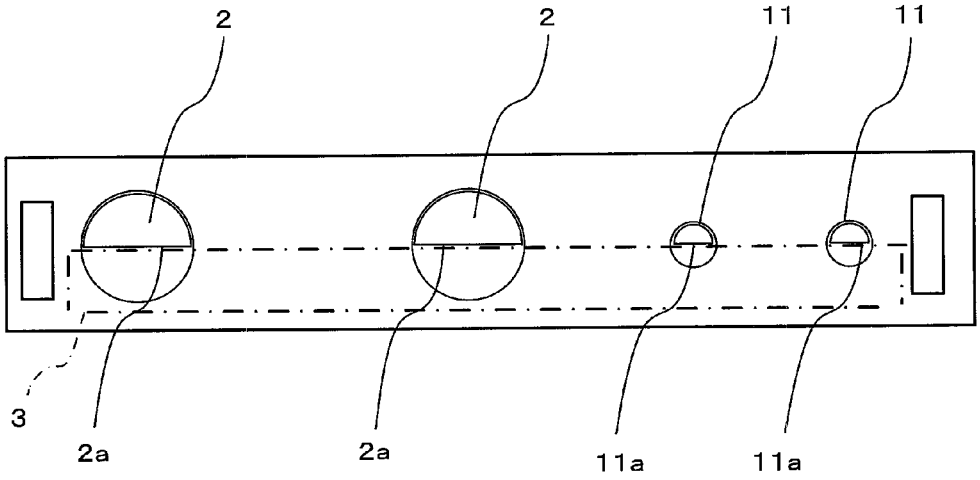
FIG. 6 is a back view of another embodiment of the present invention.
Figure 7:
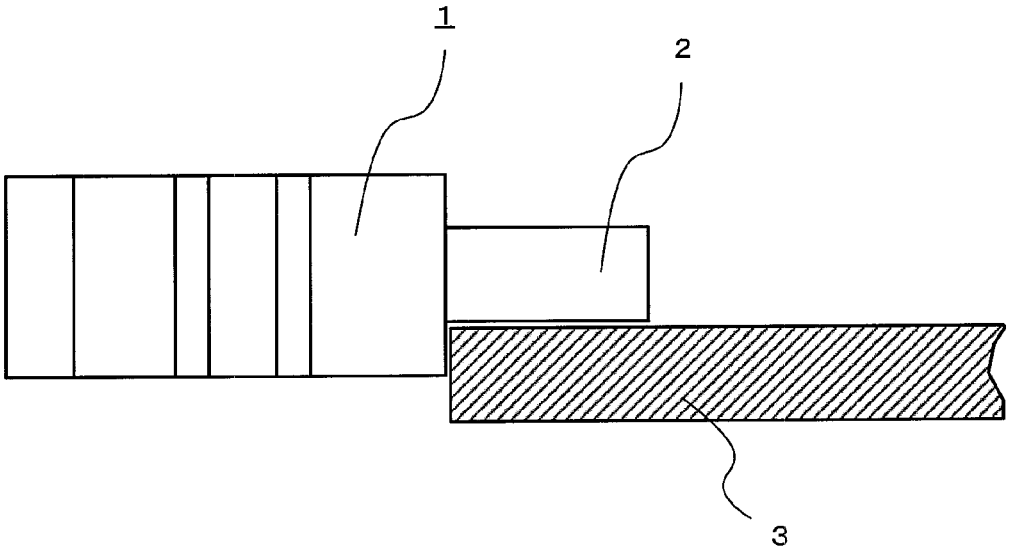
FIG. 7 is a back view showing an example of a conventional power supply connector.
Figure 8:
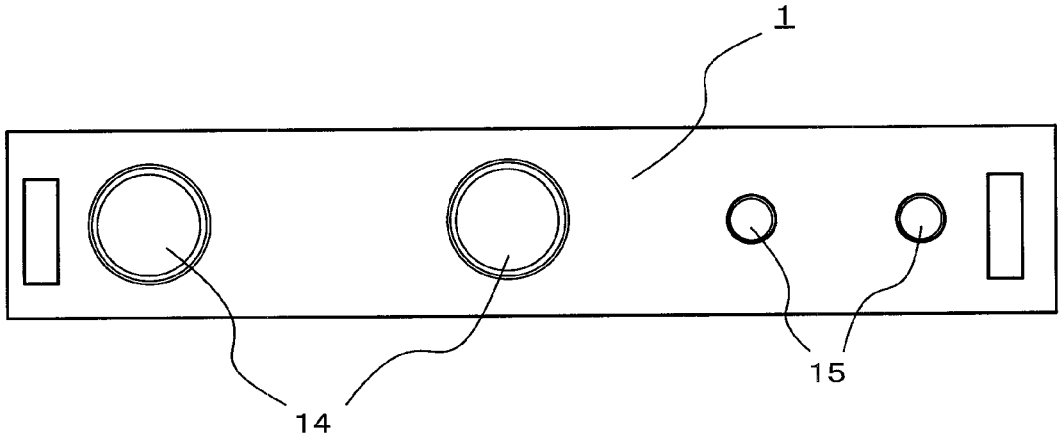
FIG. 8 is a front view showing an example of the conventional power supply connector.
Figure 9:
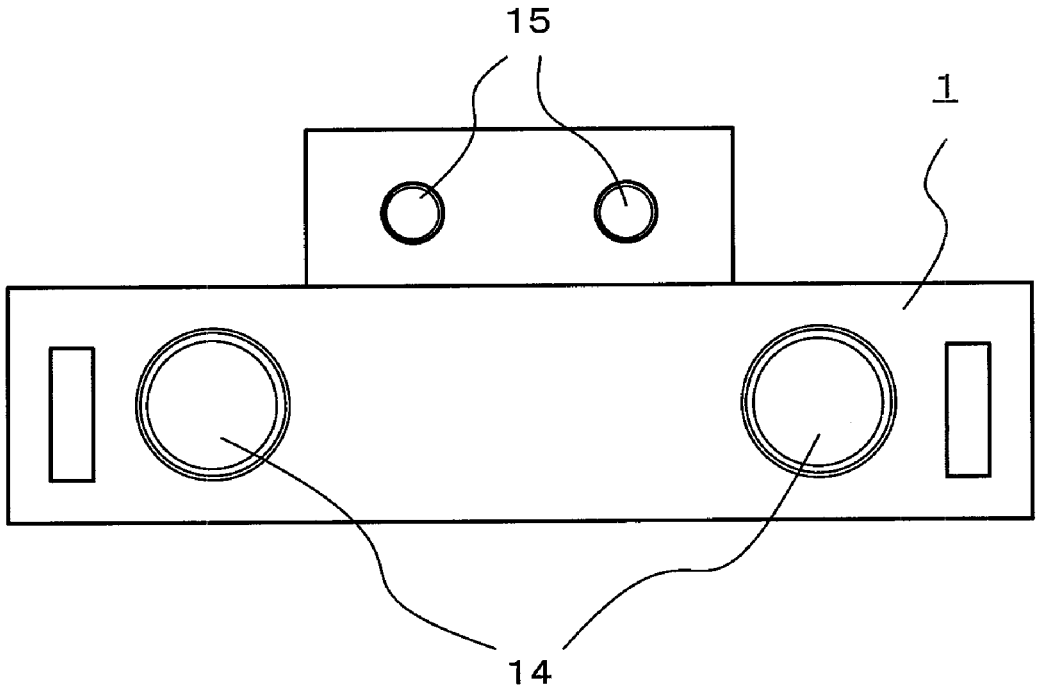
FIG. 9 is a front view showing an example of the conventional power supply connector.

Note that the present invention is not limited to the embodiments described above, and the configurations of the members such as the connector pins and the signal pins, the number of places to dispose these members, and the places to dispose these members can be changed appropriately. Specifically, when the height needs to be reduced and the width does not have to be reduced much, but when the large current charging plug and the low current charging plug have to be inserted simultaneously, it is possible to implement an embodiment in which the pair of large current charging connector pins 2 provided with the flat surface parts 2*a* and the pair of low current charging connector pins 11 are arranged simply in this order, as shown in FIG. 6. As a result of using this embodiment, not only is it possible to achieve the effects of reducing the height by providing the connector pins with the flat surface parts, but also the large current charging plug and the lo current charging plug can be inserted simultaneously. As a result, a very convenient power supply connector can be obtained.

Regarding the shape of the connector pins, the end of each connector pin may be in the shape of a plate, so that the work of connecting the connector pins with the circuit board or the metal plate can be carried out easily in this embodiment. Moreover, the signal pins may be shaped into a simple letter of L, other than a crank. Note that when fixing the connector pins provided with the flat surface parts to the circuit board or the metal plate, these members may be fixedly connected by means of welding or soldering, instead of using screws. In either case, the connector pins and the circuit board or the metal plate are fixed while the flat surfaces of the connector pins are brought into surface contact with the flat surface of the circuit board or metal plate to be fixed, whereby good workability can be accomplished.

The present invention is not only applied to a battery pack of an electric bicycle, but also to any types of power supply connectors in which charging plugs are inserted, and can be utilized in a hybrid vehicle or an industrial conveying vehicle. Furthermore, the number of the charging plugs to be inserted, and the shape and specification thereof can be selected appropriately. For example, the characteristics of the flat surface of the connector pins of the present invention can be applied to a power supply connector that is applicable only to a large current charging plug and specially used for large current charging. In this case well, reduction of the height of the power supply connector and increase of the contact area can be achieved by providing connector pins with the flat surface parts, whereby the same function effects can be obtained.

The invention claimed is:

1. A power supply connector in which a front surface part is provided with a plurality of insertion parts including a pair of large current charging insertion parts into which large current charging plugs are inserted, a rear surface part is provided with a plurality of connector pins including a pair of large current charging connector pins, and these connector pins are connected with a circuit board or a metal plate to form a large current charging connector part configured by the pair of large current charging insertion parts and the pair of large current charging connector pins, wherein:

the large current charging connector part is configured by two positionally divided sections, these divided sections are disposed and separated by a space such that one end of each of the divided sections is positioned in the vicinity of both ends of the front surface part, and a low current charging connector part is disposed in a position between these two divided sections, wherein:

the plurality of connector pins are each provided with a flat surface part that is in surface contact with the circuit board or the metal plate; and the flat surface part is provided by forming the cross section of each of the connector pins into substantially semicircular.

2. The power supply connector according to claim 1, wherein:

the circuit board that is connected with the plurality of connector pins is provided with a large current charge monitoring protection circuit and a low current charge monitoring protection circuit, separately.

3. A power supply connector in which a front surface part is provided with a plurality of insertion parts including a pair of large current charging insertion parts into which large current charging plugs are inserted, a rear surface part is provided with a plurality of connector pins including a pair of large current charging connector pins, and these connector pins are connected with a circuit board or a metal plate to form a large current charging connector part configured by the pair of large current charging insertion parts and the pair of large current charging connector pins, wherein:

the plurality of connector pins are each provided with a flat surface part that is in surface contact with the circuit board or the metal plate; and the flat surface part is provided by forming the cross section of each of the connector pins into substantially semicircular.

4. The power supply connector according to claim 1 or claim 3, wherein:

the plurality of connector pins are provided such that the flat surface parts of each connector pin positioned on the same plane surface.

5. The power supply connector according to claim 1 or claim 3, wherein:

each of the plurality of connector pins is fixed to the circuit board or the metal plate by means of welding, soldering, or using screws.

6. The power supply connector according to claim 1 or claim 3, wherein:

the connector parts are configured asymmetrically with respect to the vertical direction, respectively.

* * * * *